US009963950B2

(12) United States Patent
Gilmore et al.

(10) Patent No.: US 9,963,950 B2
(45) Date of Patent: May 8, 2018

(54) MULTI-FUNCTION TOOL FOR A DRILLING RISER

(71) Applicant: Cameron International Corporation, Houston, TX (US)

(72) Inventors: David L. Gilmore, Highlands, TX (US); William F. Puccio, Katy, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days. days.

(21) Appl. No.: 14/948,159

(22) Filed: Nov. 20, 2015

(65) Prior Publication Data

US 2017/0145768 A1 May 25, 2017

(51) Int. Cl.

| | |
|---|---|
| ***E21B 17/01*** | (2006.01) |
| ***E21B 29/12*** | (2006.01) |
| ***E21B 47/00*** | (2012.01) |
| *E21B 17/05* | (2006.01) |
| *E21B 17/07* | (2006.01) |

(52) U.S. Cl.

CPC ..... *E21B 29/12* (2013.01); *E21B 17/01* (2013.01); *E21B 47/0001* (2013.01); *E21B 17/05* (2013.01); *E21B 17/07* (2013.01)

(58) Field of Classification Search

CPC ..... E21B 17/01; E21B 17/05; E21B 17/07; E21B 19/10; E21B 29/12; E21B 47/0001; B23B 3/265; B23B 5/161; B23D 21/00; B26D 3/16; B26D 3/166

See application file for complete search history.

(56) References Cited

U.S. PATENT DOCUMENTS 3,279,079 A * 10/1966 Schiler ..... G01B 5/004 33/1 M
3,772,944 A * 11/1973 Becker ..... B23B 3/06 82/113
3,823,482 A * 7/1974 Schiler ..... G01B 5/012 33/520
4,050,335 A * 9/1977 Gilmore ..... B23B 3/265 82/113
4,186,630 A * 2/1980 Lindhag ..... B23B 3/265 82/113
4,259,885 A * 4/1981 Lindhag ..... B23B 3/265 82/128
4,326,336 A * 4/1982 Hreha ..... G01B 5/00 33/542
4,718,201 A * 1/1988 Legge ..... B23D 45/003 30/103
5,050,291 A * 9/1991 Gilmore ..... B23B 3/265 29/560
5,582,538 A * 12/1996 Hillestad ..... B23D 45/006 451/154

(Continued)

*Primary Examiner* — Matthew R Buck
(74) *Attorney, Agent, or Firm* — Helene Raybaud

(57) ABSTRACT

Embodiments of the present disclosure include a multi-function tool that includes a positioning assembly configured to move with a first degree of freedom of rotation, a second degree of freedom of axial movement in a first direction, and a third degree of freedom of axial movement in a second direction crosswise to the first direction, a cutting tool configured to selectively couple to the positioning assembly, and a measurement tool configured to selectively couple to the positioning assembly.

22 Claims, 8 Drawing Sheets

(56) References Cited

U.S. PATENT DOCUMENTS

| | | | | | |
|---|---|---|---|---|---|
| 5,630,346 | A * | 5/1997 | Strait | B23B 3/265 | 82/113 |
| 6,148,532 | A * | 11/2000 | Ellis | G01B 5/285 | 33/533 |
| 6,497,047 | B1 * | 12/2002 | Miyagawa | G01B 11/306 | 33/1 BB |
| 7,328,520 | B2 * | 2/2008 | Galle, Sr. | G01B 5/08 | 33/783 |
| 8,333,211 | B2 * | 12/2012 | McGraw | E21B 29/12 | 137/15.12 |
| 8,820,205 | B1 * | 9/2014 | Smith | B23D 45/042 | 83/483 |
| 9,089,899 | B2 * | 7/2015 | Place | B23B 3/265 | |
| 9,199,344 | B1 * | 12/2015 | Smith | E21B 15/02 | |
| 2011/0179933 | A1 * | 7/2011 | Ahn | B23B 3/265 | 83/745 |
| 2013/0058732 | A1 * | 3/2013 | Anda | B23B 29/03432 | 408/108 |
| 2014/0196582 | A1 * | 7/2014 | Pierce | B23D 21/04 | 82/47 |
| 2016/0084633 | A1 * | 3/2016 | Ferrari | G01B 21/04 | 33/503 |

* cited by examiner

FIG. 4
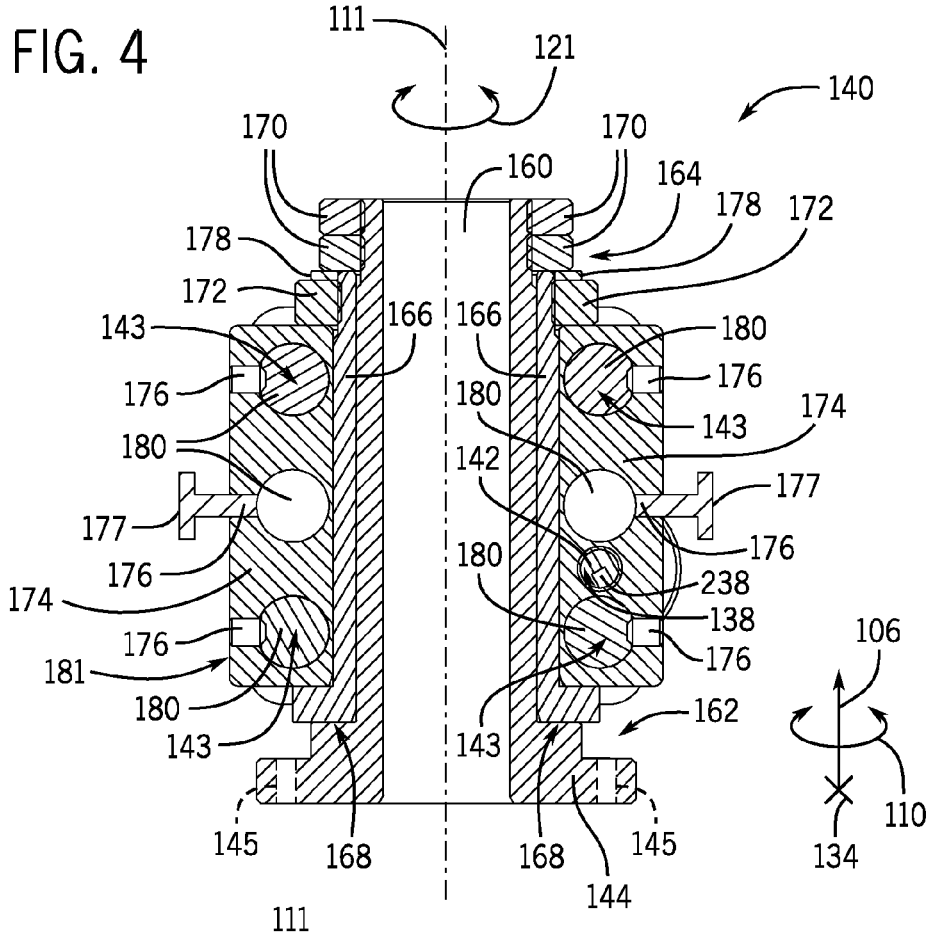
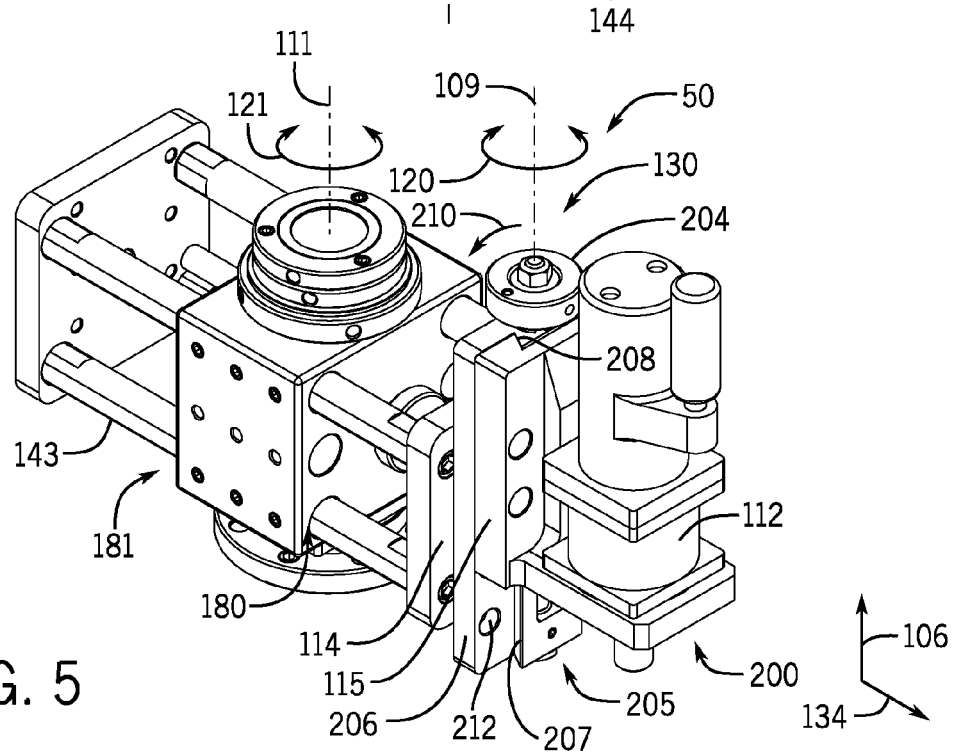
FIG. 5

MULTI-FUNCTION TOOL FOR A DRILLING RISER

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are often employed to access and extract the resource. These systems can be located onshore or offshore depending on the location of the desired resource.

To extract the resources from a well, a drilling riser may extend from the well to a rig. For example, in a subsea well, the drilling riser may extend from the seafloor up to a rig on the surface of the sea. A typical drilling riser may include a flanged assembly, and the drilling riser may perform multiple functions. In addition to transporting drilling fluid into the well, the riser may provide pipes to allow drilling fluids, mud, and cuttings to flow up from the well.

The riser is typically constructed by securing riser segments together via a flanged connection. Specifically, a first riser segment may be lowered from the rig into the sea. A subsequent riser segment may then be secured to the first segment, before lowering the entire stack. In this manner, a riser of a desired length may be formed. However, each riser segment may include multiple lines (e.g., pipes) configured to carry the various fluids toward or away from the well. Unfortunately, when extending lines along each riser segment, the lines may have different lengths and/or positions relative to the flanges.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein:

FIG. 4 is a cross-section of a swiveling base of the multi-function tool of FIGS. 2 and 3, in accordance with certain embodiments of the present disclosure;

FIG. 5 is a perspective view of the multi-function tool of FIGS. 2-4 in a first vertical position, in accordance with certain embodiments of the present disclosure;

DETAILED DESCRIPTION OF SPECIFIC EMBODIMENTS

Figure 1:
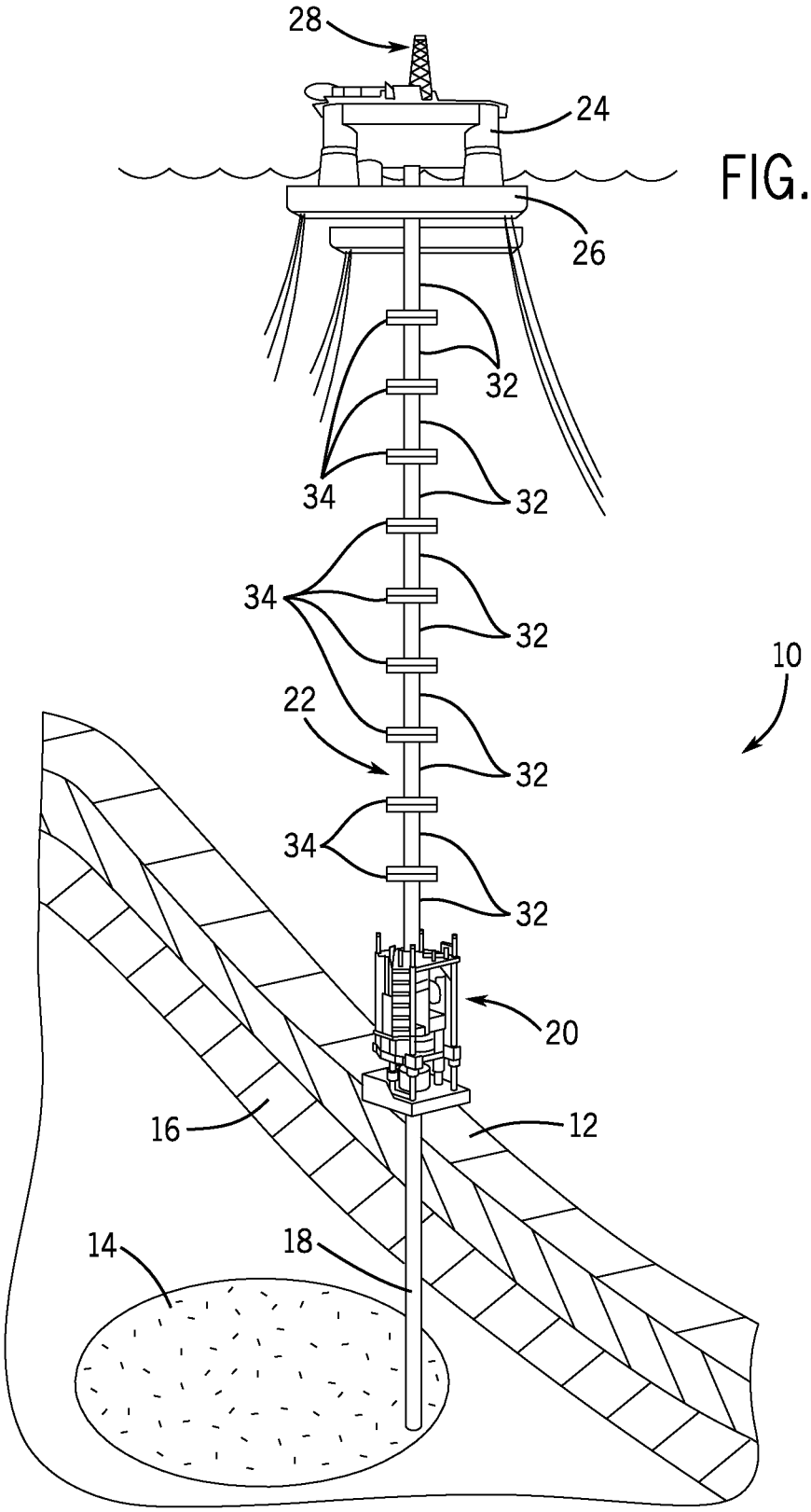
FIG. 1 is a block diagram of a mineral extraction system, in accordance with certain embodiments of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Drilling risers are constructed utilizing a number of riser segments that may be coupled to one another via flanges to ultimately form the drilling riser. Each riser segment may include a main line that may be utilized for drilling and/or returning hydrocarbons from the well to the surface. Additionally, each riser segment may include one or more auxiliary lines that are utilized to direct mud, drilling fluid, chemical injection fluid, and/or other substances to and from the well. For example, auxiliary lines may include choke lines, kill lines, hydraulic lines, glycol injection lines, mud return lines, and/or mud boost lines. The main line and the one or more auxiliary lines of the drilling riser segment may be referred to as a tubing assembly.

When coupling the riser segments to one another, it may be desirable to align each of the auxiliary lines with one another such that each auxiliary line of an individual riser segment extends a substantially equal distance from a surface of the riser segment (e.g., the flange). Accordingly, when coupling a first riser segment to a second riser segment, it may be desirable to cut each line (e.g., pipe) of the riser segment to include an equal height or distance from a surface of the riser segment. Aligning the heights of each line (e.g., pipe) of the riser segment may prevent leakage, breakage, and/or scarring of the lines due to movement of the riser (e.g., caused by waves and/or wind). Additionally, tolerances may be established regarding surfaces of the riser segments and/or the flanged assembly. Therefore, it may be desirable to utilize a tool to measure (e.g., indicate) the surfaces of the riser segments and/or the flanged assembly to confirm that each surface meets the established tolerances to ensure a secure connection between riser segments.

In accordance with embodiments of the present disclosure, a cutting tool may be coupled to the riser segment and utilized to cut one or more of the auxiliary lines in order to substantially align each of the auxiliary lines with one another. It may be desirable for the cutting tool to include multiple degrees of freedom so that the cutting tool may be coupled to the riser, but still include flexibility to cut one or more auxiliary lines that may include varying diameters. For example, it may be desirable for the cutting tool to be adjustable both vertically and horizontally so that the cutting tool may cut each auxiliary line to a desired height and so that the cutting tool may reach (e.g., cut through) auxiliary lines having different diameters. Additionally, it may be desirable for the cutting tool to be mounted on a swiveling base (e.g., swivel joint) so that the cutting tool may rotate in a back and forth motion to cut through an entire perimeter of an auxiliary line. Therefore, in some embodiments, the multi-function tool may include a positioning assembly that may enable the multi-function tool to move with at least three degrees of freedom when mounted to the riser segment (e.g., vertical adjustments, horizontal adjustments, and swiveling or rotating in a back and forth motion to cut the auxiliary line).

Additionally, riser segments and/or the flanges that connect riser segments may include various surfaces such as flat surfaces, angled surfaces, round surfaces, inner diameters of pipes/conduits, outer diameters of pipes/conduits, spherical surfaces, tapered surfaces, portions of surfaces, or any combination thereof. In some cases, tolerances may be established for each surface of the riser segment and/or the flange. As used herein a "tolerance" may be an amount of variation in a surface parameter (e.g., flatness, uniformity, evenness, diameter, circumference, and/or thickness, among other parameters) that may be acceptable for construction standards (e.g., slight variations may enable a secure connection). Accordingly, a measurement tool that includes an indicator may be utilized to determine whether one or more of the surfaces of the riser segment and/or the flange conform to predetermined tolerances. As used herein an "indicator" may include a device used to accurately measure relatively small distances and/or angles to detect unnoticeable imperfections and/or inequalities in a surface. Utilizing the measurement tool may ensure that each riser segment and/or flange meets predetermined tolerances, and thus, ensure that a reliable connection between riser segments is established upon completion.

It is now recognized that it may be desirable to manufacture a single, multi-function tool capable of cutting the auxiliary lines of a riser segment as well as measuring one or more surfaces of the riser segment and/or the flange. Such a tool may reduce the amount of items brought to the construction and/or drilling site, which in turn, may reduce costs of construction. Additionally, the multi-function tool may enable enhanced cutting of the auxiliary lines (e.g., the multi-function tool may be quickly adjusted) and/or measurement of riser segment surfaces (e.g., multiple surfaces may be measured simultaneously).

To help illustrate the manner in which the present embodiments may be used in a system, FIG. 1 is a block diagram that illustrates an embodiment of a subsea mineral extraction system 10. The illustrated mineral extraction system 10 may be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead assembly 12 coupled to a mineral deposit 14 via a well 16, wherein the well 16 includes a well-bore 18.

The wellhead assembly 12 typically includes multiple components that control and regulate activities and conditions associated with the well 16. For example, the wellhead assembly 12 generally includes bodies, valves, and seals that route produced minerals from the mineral deposit 14, provide for regulating pressure in the well 16, and provide for the injection of chemicals into the well-bore 18 (e.g., downhole). In the illustrated embodiment, the wellhead 12 may include a tubing spool, a casing spool, and a hanger (e.g., a tubing hanger or a casing hanger). The system 10 may include other devices that are coupled to the wellhead 12, such as a blowout preventer (BOP) stack 20 and devices that are used to assemble and control various components of the wellhead 12.

A drilling riser 22 may extend from the BOP stack 20 to a rig 24, such as a platform or floating vessel 26. The rig 24 may be positioned above the well 16 and may include the components suitable for operation of the mineral extraction system 10, such as pumps, tanks, power equipment, and any other suitable components. The rig 24 may also include a derrick 28 to support the drilling riser 22 during running and retrieval and a tension control mechanism, among other components.

The wellhead assembly may include the blowout preventer (BOP) stack 20. The BOP stack 20 may consist of a variety of valves, fittings, and controls to block oil, gas, or other fluid from exiting the well in the event of an unintentional release of pressure or an overpressure condition. These valves, fittings, and controls are referred to herein as the "BOP stack" 20.

The drilling riser may carry drilling fluid (e.g., "mud") from the rig 24 to the well 16, and may carry the drilling fluid (e.g., "returns"), cuttings, or any other substance, from the well 16 to the rig 24. The drilling riser 22 may include a main line having a large diameter and one or more auxiliary lines. The main line may be connected centrally over the bore (such as coaxially) of the well 16, and may provide a passage from the rig to the well. The auxiliary lines may include choke lines, kill lines, hydraulic lines, glycol injection lines, mud return lines, and/or mud boost lines. For example, some of the auxiliary lines may be coupled to the BOP stack 20 to provide choke and kill functions to the BOP stack 20.

As described further below, the drilling riser 22 may be formed from numerous "joints" or segments 32 of pipe, coupled together via flanges 34, or any other suitable devices. Additionally, the drilling riser 22 may include flotation devices, clamps, or other devices distributed along the length of the drilling riser 22. In certain embodiments, as the riser 22 is being assembled, a riser segment 32 may be secured to a spider by multiple dogs that engage the flange 34. A subsequent riser segment 32 may then be bolted to the riser segment 32 within the spider. The riser 22 may be lowered toward the well, and the next segment 32 is secured to the spider. This process facilitates riser construction by building the riser 22 one segment 32 at a time. The spider may be supported by a gimbal that enables the spider to rotate relative to the platform 26 as the platform moves with the wind and/or waves.

The auxiliary lines may pass through the segments 32 of the riser 22 via holes and/or openings in the segments 32 and/or the flanges 34. The auxiliary lines of each segment 32 may be coupled to one another by a coupling device (e.g., a pin and box connection) prior to the flange 34 being disposed over the two segments 32. However, in some cases, a first auxiliary line of the segment 32 may include a length greater than or less than a second auxiliary line of the segment 32. Accordingly, it may be desirable to utilize a tool to adjust (e.g., cut) a length of one or more of the auxiliary lines of each segment 32 so that each auxiliary line is aligned with the remaining auxiliary lines (e.g., uniform or equal position, height, etc. relative to the flange 34). As such, leakage, breakage, and/or scarring of the auxiliary lines may be substantially avoided. It may also be desirable for the tool to include additional features that may enable the tool to perform functions other than cutting the auxiliary lines. For example, in accordance with embodiments of the present disclosure, it may be desirable for the tool to include a measurement function (e.g., indicating) such that the tool may determine whether one or more surfaces of the segment 32 and/or the flange 34 fall within predetermined tolerance specifications.

Figure 2:
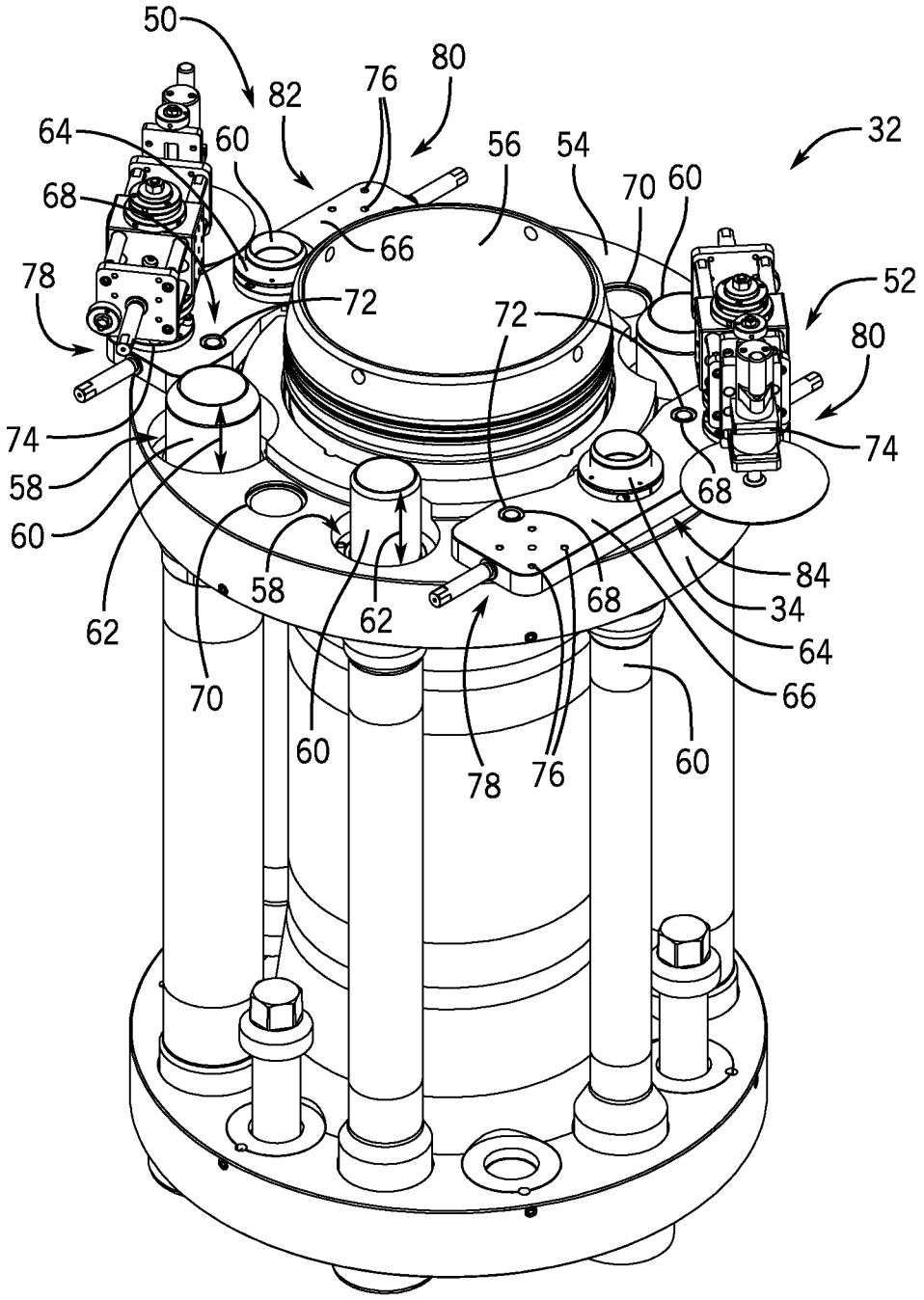
FIG. 2 is a perspective view of a riser segment of the mineral extraction system of FIG. 1 that includes a multi-function tool, in accordance with certain embodiments of the present disclosure.

Embodiments of the present disclosure are directed toward a multi-function tool 50 that may be utilized to perform both cutting functions (e.g., of the auxiliary lines) and measurement functions (e.g., of surfaces of the flange 34). For example, FIG. 2 is a perspective view of a segment 32 of the riser 22 that includes the multi-function tool 50 and an additional multi-function tool 52 disposed on a surface 54 of the flange 34. As shown in the illustrated embodiment of FIG. 2, the multi-function tool 50 may be disposed on the surface 54 of the flange 34 and around a main line 56 of the riser 22. The flange 34 may include a plurality of openings 58 configured to receive auxiliary lines 60, which may pass through the openings 58. As shown in FIG. 2, the segment 32 may include five auxiliary lines 60. However, it should be noted that in other embodiments, the segment 32 may include less than five auxiliary lines 50 (e.g., 4, 3, 2, 1, or 0), or the segment 32 may include more than five auxiliary lines 50 (e.g., 6, 7, 8, 9, 10, or more).

In some embodiments, the auxiliary lines 60 may extend a distance 62 beyond the surface 54 of the flange 34 such that a connection may be made with auxiliary lines (not shown) of another segment 32 of the riser 22. However, the distance 62 that each auxiliary line 60 extends beyond the surface 54 may not be equal, which may result in leakage, breakage, and/or scarring of misaligned auxiliary lines caused by stress due to movement of the riser 22, for example.

Accordingly, the multi-function tool 50 may be utilized to cut one or more of the auxiliary lines 60 such that the distance 62 that each auxiliary line 60 extends beyond the surface 54 of the flange 34 may be substantially equal. For example, as shown in the illustrated embodiment of FIG. 2, the multi-function tool 50 may be mounted to the flange 34 such that an auxiliary line 60 extends through a spindle flange 64 (e.g., annular flange and/or a tubing adapter insert) of the multi-function tool 50 that is configured to stabilize the auxiliary line 60 during cutting. In some embodiments, an inner diameter and/or a height of the spindle flange 64 may be selected based on a diameter of the auxiliary line 60 and/or the distance 62. Therefore, the spindle flange 64 may be replaced with one of a plurality of spindle flanges that may be more suitable to accommodate cutting of a specific auxiliary line 60. The spindle flange 64 will be discussed in more detail herein with reference to FIG. 3. The multi-function tool 50 may also include a base 66 (e.g., a mounting base) with mounting holes 68 (e.g., a mounting interface) configured to be aligned with openings 70 of the flange 34. Accordingly, to mount the base 66 of the multi-function tool 50 to the flange 34, fastening features 72 (e.g., threaded fasteners, screws, bolts, clamps, or rivets) may be configured to extend through the mounting holes 68 (e.g., mounting interface) and into the openings 70 of the flange 32, which may couple the base 66 to the flange 34. As such, the base 66 may remain substantially stationary with respect to the flange 34 such that the multi-function tool 50 may remain substantially stable when cutting one or more of the auxiliary lines 60.

Additionally, the multi-function tool 50 may be mounted to the base 66 via a universal mounting flange 74. As shown in the illustrated embodiment, the base 66 may include one or more holes 76 (e.g., 1, 2, 3, 4, 5, 6, or more) that may receive a fastening device (e.g., a threaded fastener, a screw, a bolt, a clamp, or a rivet) to fasten the universal mounting flange 74 to the base 66. The universal mounting flange 74 may be disposed on a first side 78 of the base 66 and/or a second side 80 of the base 66. Therefore, the multi-function tool 50 may be configured to cut at least two or three different auxiliary lines 60 when the base 66 is mounted in any given position on the flange 34. In the illustrated embodiment of FIG. 2, two bases 66 may be mounted to the flange 34 in a first position 82 and a second position 84 of the flange 34. Mounting the two bases 66 in the first and second positions 82, 84 may enable the multi-function cutting tool 50 to reach each of the six auxiliary lines 60 when mounted to one of the two bases 66. While the two bases 66 are illustrated as mounted in the first position 82 and the second position 84, it should be noted that the bases 66 may be mounted to the flange 34 such that the spindle flange 64 of the base 66 is positioned over any of the auxiliary lines 60.

Figure 3:
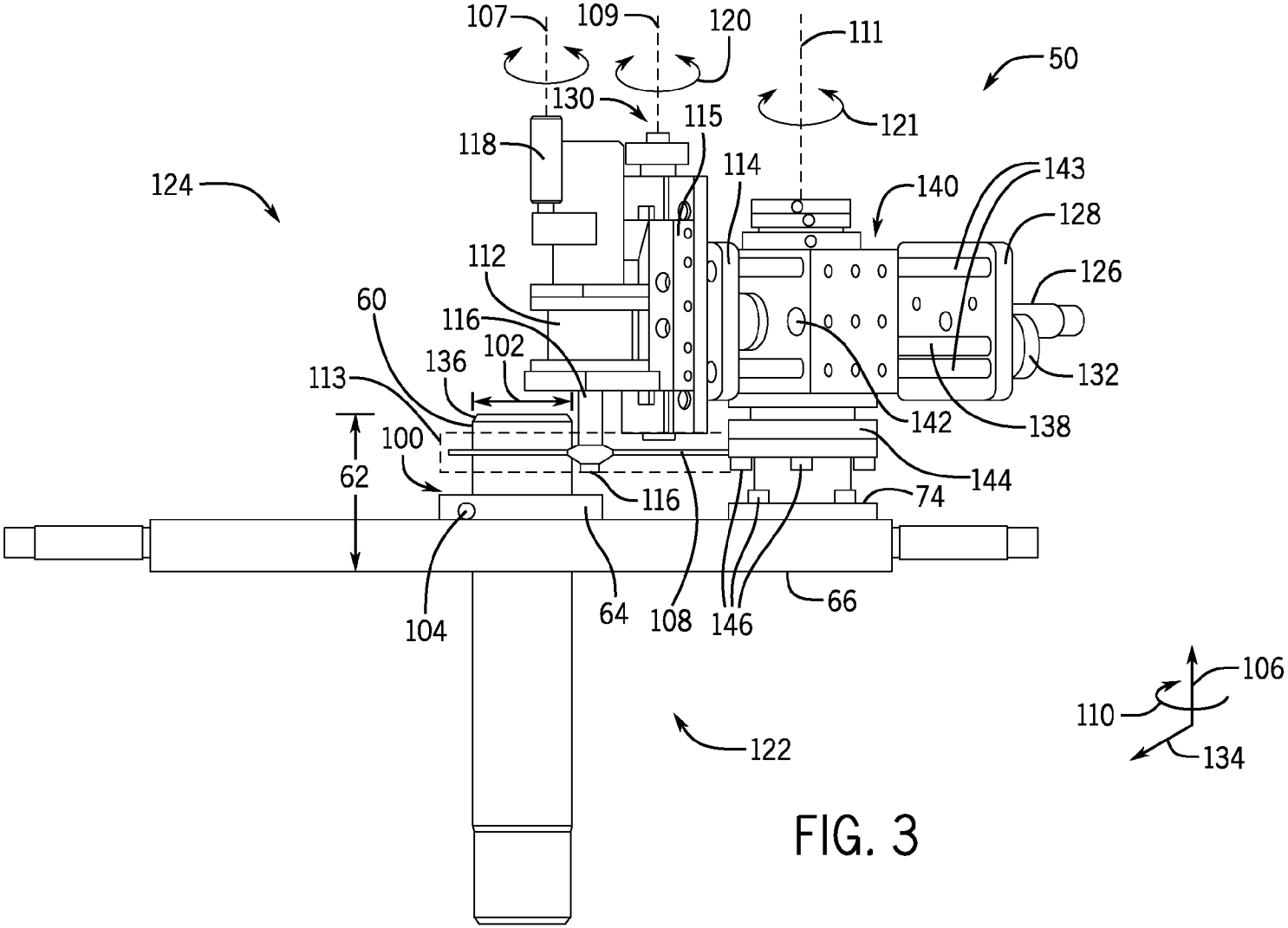
FIG. 3 is an expanded perspective view of the multi-function tool of FIG. 2, in accordance with certain embodiments of the present disclosure.

To help clarify various features of the multi-function tool 50 when adapted for the cutting function, FIG. 3 is an expanded perspective view of the multi-function tool 50. As discussed above, the multi-function tool 50 may be utilized to cut the auxiliary line 60 such that it extends the distance 62 beyond the flange 34, and thus, includes a height substantially equal to the remaining auxiliary lines 60. By cutting the auxiliary lines 60 such that they each extend the same distance 62 beyond the flange 34, leakage, breakage, and/or scarring of the auxiliary lines 60 may be avoided when the riser 22 incurs movement (e.g., due to wind and/or waves). As shown in the illustrated embodiment of FIG. 3, an auxiliary line 60 is shown extending through the base 66 of the multi-function tool 50, and specifically, through the spindle flange 64 (e.g., tubing adapter insert). The spindle flange 64 may be mounted to the base 66 via one or more fasteners that may extend through the spindle flange 64 and into threaded holes of the base 66, for example. Accordingly, in some embodiments, the spindle flange 64 may be substantially stationary with respect to the base 66. In other embodiments, the spindle flange 64 may be adjustable, such that a surface 100 of the spindle flange 64 may be positioned approximately at the distance 62 beyond the flange 34.

Additionally, the spindle flange 64 may be selected from the plurality of spindle flanges, for example, to include a diameter larger than a diameter 102 of the auxiliary line 60 such that the auxiliary line 60 may pass through the spindle flange 64. In certain embodiments, the diameter of the spindle flange 64 may be sized for the specific auxiliary line to be cut. For example, the diameter 102 of the auxiliary line 60 may vary depending on the fluid the auxiliary line 60 is designed to carry (e.g., hydraulic fluid, mud, chemical injection fluid). Accordingly, in certain embodiments, the spindle flange 64 may be sized for a specific auxiliary line 60. In other embodiments, the spindle flange 64 may include a uniform diameter that may receive any sized auxiliary line 60.

The spindle flange 64 may also include a stabilization screw 104 to block movement of the auxiliary line 60 when cutting. For example, the stabilization screw 104 may be substantially loosened when positioning the auxiliary line 60 through the base 66 and the spindle flange 64. However, once the auxiliary line 60 is positioned through the spindle flange 64, the stabilization screw 104 may be tightened such that the auxiliary line 60 is substantially stationary (e.g., does not move along a vertical axis 106). It may be desirable for the auxiliary line 60 to remain substantially stationary with respect to the vertical axis 106 such that the multi-function tool 50 can cut the auxiliary line 60 evenly, thereby facilitating alignment of each auxiliary line 60 with one another (e.g., each auxiliary line 60 of the segment includes substantially the same distance 62 from the surface 54 of the flange 32).

In order to cut the auxiliary line 60, the multi-function tool 50 may include a blade 108 (e.g., a cutting blade) that may rotate in a circumferential direction 110 about an axis 107. In certain embodiments, the blade 108 may include a material that is harder (e.g., more abrasive) than a material of the auxiliary line 60 such that when the rotating blade 108 contacts the auxiliary line 60, pieces of the auxiliary line 60 may be chipped away, thereby cutting the auxiliary line 60. Accordingly, in certain embodiments, the blade 108 may include a diamond-based material. To ensure that the blade 108 cuts the auxiliary line 60, the blade 108 may rotate in the circumferential direction 110 about the axis 107 at a relatively high speed. In certain embodiments, the blade 108 may spin at a speed of between 1000 revolutions per minute (RPM) and 10,000 RPM, between 2000 RPM and 9000 RPM, or between 5000 and 7000 RPM. To rotate the blade 108 about the axis 107, the multi-function tool 50 may include a motor 112 (e.g., a drive) disposed on (e.g., coupled to) a first parallel plate 114 (e.g., a first plate) of the multi-function tool 50 via a mounting plate 115. In certain embodiments, the motor 112 may be a pneumatic motor, a hydraulic motor, or an electric motor. In other embodiments, the motor 112 may include any suitable motor configured to rotate the blade 108 around the axis 107 at a speed that may cut the auxiliary line 60. In addition to holding the motor 112, the mounting face 115 may also include a mounting feature 116 (e.g., threaded fastener, or nut) configured to couple to the blade 108, such that the blade 108 is coupled to the first parallel plate 114 (e.g., via the mounting plate 115).

As shown in the illustrated embodiment of FIG. 3, the motor 112 may include an air exhaust 118 that enables air to vent from the motor 112 and into a surrounding environment of the multi-function tool 50. In some embodiments, the air exhaust 118 may include a sleeve that enables the air exhaust 118 to act as a handle to move the blade 108 in the direction 121 about the axis 111. Therefore, the operator may move the blade 108 from a first position on a first side 122 of the auxiliary line 60 toward a second position on a second side 124 of the auxiliary line 60. As the blade moves from the first position to the second position, the blade 108 may contact and cut through an entire perimeter of the auxiliary line 60, such that the auxiliary line 60 reaches a predetermined height (e.g., the height aligning the auxiliary line 60 with the remaining auxiliary lines 60 of the segment 32). Additionally, a second handle 126 (e.g., an extended handle) may be disposed on a second parallel plate 128 (e.g., a second plate) of the multi-function tool 50 to further facilitate movement of the blade 108 in the circumferential direction 110 (e.g., direction 121 about an axis 111). In certain embodiments, the blade 108 may include a guard 113 that is configured to cover at least a portion of the blade 108 such that the blade 108 does not contact any components of the segment 32 not intended to be cut. Additionally, the guard may protect the blade 108 from debris and/or materials that may chip, crack, or otherwise damage the blade 108.

In certain embodiments, the multi-function tool 50 may be adjusted along a plurality of different axes (in addition to rotation about the circumferential axis 111) such that blade 108 may reach the auxiliary line 60 to be cut, and so that the blade 108 may cut the auxiliary line 60 to the predetermined height (e.g., the height aligning the auxiliary line 60 with the remaining auxiliary lines 60 of the segment 32). Accordingly, the multi-function tool 50 may include a vertical adjustment feature 130 (e.g., first adjustment feature and/or first axial translation joint) that is configured to adjust a position of the blade 108 along the vertical axis 106. Additionally, the multi-function tool 50 may include a horizontal adjustment feature 132 (e.g., second adjustment feature and/or second axial translation joint) configured to adjust the blade along a horizontal axis 134. The vertical adjustment feature 130 and/or the horizontal adjustment feature 132 may be manually operated (e.g., manually adjusted by an operator) or operated by a power-generating device (e.g., an engine or motor). Accordingly, the multi-function tool 50 may include three or four degrees of freedom (e.g., movement along the vertical axis 106, movement along the horizontal axis 134, and rotation in the circumferential direction 110 about axis 111) to enable the multi-function tool 50 to access and cut auxiliary lines 60 having various diameters and disposed in various positions of the segment 32, such that the distance 62 that each auxiliary line 60 extends beyond the flange 34 is substantially equal. In some embodiments, a handle may be positioned on the vertical adjustment feature 130 and/or the horizontal adjustment feature 132 to facilitate movement of the multi-function tool 50 (and thus the blade 108) in the direction 121 about the axis 111.

In some cases, it may be desirable to move the blade 108 along the vertical axis 106 so that the auxiliary line 60 may be cut to the predetermined height (e.g., the height that places the auxiliary line 60 in alignment with each of the other auxiliary lines 60 of the segment 32). The vertical adjustment feature 130 may be configured to move the blade 108, the motor 112, the mounting plate 115 (e.g., mounting portion), and/or the mounting feature 116 along the vertical axis 106 with respect to the first parallel plate 114 (e.g., the first parallel plate 114 remains substantially stationary with respect to the vertical axis 106). Therefore, an operator may spin (e.g., in a direction 120 about an axis 109) or otherwise adjust the vertical adjustment feature 130 so that the blade 108 may contact the auxiliary line 60 at the predetermined height (e.g., a threaded rod may be configured to rotate in a threaded opening of the mounting plate 115 such that the mounting plate 115 moves along the vertical axis 106 as the threaded rod is rotated via the vertical adjustment feature 130). Adjusting the blade along the vertical axis 106 is discussed in more detail herein with reference to FIGS. 5 and 6.

Additionally, it may be desirable to adjust the blade 108 along the horizontal axis 134 such that the blade 108 may reach and cut an entire perimeter 136 of the auxiliary line 60. For example, in some embodiments, the multi-function tool 50 may be disposed on the base 66 and/or the flange 34 in an initial position where the blade 108 may not reach and/or contact the entire perimeter 136 of the auxiliary line 60. Accordingly, an operator may spin or otherwise adjust the horizontal adjustment feature 132 such that the multi-function tool 50 (and thus the blade 108) may be directed along the horizontal axis 134 to reach the auxiliary line 60.

For example, the horizontal adjustment feature 132 may be coupled to a threaded rod 138, which may be configured to move both the first parallel plate 114 and the second parallel plate 128 along the horizontal axis 134 with respect to a swiveling base 140 (e.g., swivel joint) mounted to the universal mounting flange 74. For example, the threaded rod 138 may be fixedly coupled to the second parallel plate 128 and disposed in a threaded opening 142 in the swiveling base 140. Accordingly, as the horizontal adjustment feature 132 is adjusted, the threaded rod 138 may move the second parallel plate 128 toward or away from the swiveling base 140. Additionally, the first parallel plate 114 and the second parallel plate 128 may be coupled to one another (e.g., and thus move together) via one or more rods 143 such that the first parallel plate 114 moves away from the swiveling base 140 when the second parallel plate 128 moves toward the swiveling base 140, and the first parallel plate 114 moves toward the swiveling base 140 when the second parallel plate 128 moves away from the swiveling base 140. Adjusting the first parallel plate 114 and the second parallel plate 128 along the horizontal axis 134 may enable the blade 108 to contact and overlap with the entire perimeter 136 of the auxiliary line 60 so that the distance 62 that the auxiliary line 60 extends from the surface 54 of the flange 34 is substantially uniform over the entire perimeter 136.

As shown in the illustrated embodiment of FIG. 3, the swiveling base 140 may be mounted to the universal mounting flange 74 via a swivel flange 144. The swivel flange 144 may enable the swiveling base 140 to move in the direction 121 about the axis 111, however, the swivel flange 144 may block movement of the swiveling base 140 along the vertical axis 106 and/or the horizontal axis 134. The universal mounting flange 74 may be mounted to the base 66 via one or more fasteners (not shown) such that the universal mounting flange 74 remains substantially stationary with respect to the base 66. Additionally, the universal mounting flange 74 may include one or more leveling screws 146 that may enable the blade 108 of the multi-function tool 50 to be substantially level with (e.g., parallel to) the surface 54 of the flange 34. For example, an operator and/or assembler may adjust the leveling screws 146 so that the multi-function tool 50 (and thus the blade 108) is mounted to the base 66 at a predetermined position. Therefore, when the blade 108 cuts the auxiliary line 60, the outer perimeter 136 of the auxiliary line 60 may also be substantially level with (e.g., parallel to) the surface 54 of the flange 34. Utilizing the leveling screws 146 may enable each of the auxiliary lines 60 to include outer perimeters 136 that are substantially aligned with one another.

The swiveling base 140 may include bearings and/or other components that may facilitate rotation in the direction 121 about the axis 111 and/or mounting to the universal mounting flange 74. For example, FIG. 4 is a cross-section of the swiveling base 140 of the multi-function tool 50 when the swiveling base 140 is not coupled to the universal mounting flange 74, or the base 66. As shown in the illustrated embodiment of FIG. 4, the swiveling base 140 may include a swivel rod 160 extending from a bottom portion 162 (e.g., the bottom portion 162 includes the swivel flange 144) of the swiveling base 140 to a top portion 164 of the swiveling base 140. In some embodiments, the swiveling rod 160 may be a hollow cylinder or an annular support structure that facilitates movement about its surface area. In other embodiments, the swiveling rod 160 may include a solid cylinder or an annular support structure that facilitates movement about its surface area. In any case, the bottom portion 162 of the swiveling base 140 may include the swivel flange 144 that is configured to couple the swiveling base 140 to the universal mounting flange 74. For example, the swivel flange 144 may include one more openings and/or holes 145 configured to receive fasteners (e.g., threaded fasteners, bolts, screws, etc.) disposed in holes and/or openings of the universal mounting flange 74. Accordingly, the swiveling base 140 may be coupled to the universal mounting flange 74 and thus to the base 66.

In order to swivel (e.g., rotate) in the direction 121 about the axis 111, the swiveling rod 160 may be surrounded by an annular bearing 166 (e.g., a structure that includes a low friction material, rolling structures, or rollers) of the swiveling base 140 that is configured to rest on a ledge 168 (e.g., annular ledge, shoulder, or flange) of the swivel flange 144, for example. In certain embodiments, the annular bearing 166 may be disposed over the swiveling rod 160 such that the ledge 168 axially blocks movement of the annular bearing 166 along the vertical axis 106. Additionally, the annular bearing 166 may be further blocked from moving along the vertical axis 106 via one or more flanges 170 (e.g., threaded annular flanges) disposed at the top portion 164 of the swiveling base 140 (e.g., coupled to the swiveling rod 160). In some embodiments, the swiveling rod 160 may include threads configured to couple to the flanges 170 (e.g., threaded annular flanges). Additionally, the annular bearing 166 may be coupled to a top flange 172, which may be configured to secure a block portion 174 of the swiveling base 140 over the annular bearing 166. For example, it may be desirable to enable certain measurement features to be coupled to the swiveling base 140 to enable measurement of various surfaces of the flange 34. Such features may be coupled to the swiveling base 140 via openings 176 in the block portion 174 of the swiveling base 140. Accordingly, the block portion 174 may move about the annular bearing 166 in the direction 121 about the axis 111. In other embodiments, the block portion 174 as well as the top flange 172 may rotate with the annular bearing 166, when the annular bearing 166 is configured to move about the swiveling rod 160

In certain embodiments, it may be desirable to include a device that reduces friction between the one or more flanges 170 and the top flange 172. Accordingly, to facilitate movement of the swiveling base 140 in the direction 121 about the axis 111, a bearing 178 (e.g., a thrust bearing, a needle bearing, a ball bearing, a low friction material such as Teflon, plastics, etc.) may be disposed between the one or more flanges 170 and the top flange 172. In some embodiments, the bearing 178 may be a needle bearing that includes small cylindrical rolling devices (e.g., needles) to facilitate movement of the top flange 172 disposed between the stationary flanges 170. In other embodiments, the bearing 178 may be any suitable bearing that enhances movement between a moving component and a stationary component.

As such, friction between the flanges 170 and the top flange 172 may be reduced, and movement of the swiveling base 140 may be facilitated.

As shown in the illustrated embodiment of FIG. 4, the block portion 174 may include one or more openings 180 (e.g., parallel cylindrical bores) that may receive the rods 143 (e.g., parallel cylindrical rods) that couple the first parallel plate 114 to the second parallel plate 128. The rods 143 in the openings 180 may define an axial joint or translational side 181. In some embodiments, the rods 143 may be selectively secured within the one or more openings 180 via fasteners 177 that may be disposed in the openings 176, such that the rods 143 may be fixed in position along openings 180 in the swiveling base 140. In order to adjust the first parallel plate 114 and the second parallel plate 128 along the horizontal axis 134, the rods 143 may slide in and out of the swiveling base 140 (e.g., along the openings 180) while the fasteners 177 are retracted from the openings 176. However, it may be desirable to block movement of the rods 143 through the swiveling base 140 when the multi-function tool 50 is performing a cut. Accordingly, the fasteners 177 may be utilized to fix a position of the rods 143 along the openings 180 in the swiveling base 140, such that the multi-function tool 50 (and thus the blade 108) remains substantially fixed in the desired position along the axis 134 during the cut.

In the illustrated embodiment of FIG. 4, the block portion 174 may include six of the openings 180. Accordingly, in some embodiments, six of the rods 143 may be utilized to couple the first parallel plate 114 to the second parallel plate 128. However, in other embodiments, although six of the openings 180 are included in the block portion 174, less than six rods 143 (e.g., 5, 4, 3, 2, or 1) may be utilized to couple the first parallel plate 114 to the second parallel plate 128. It should be recognized that the block portion 174 may include any suitable number of the openings 180 to accommodate any suitable number of the rods 143 that couple the first parallel plate 114 to the second parallel plate 128.

Additionally, FIG. 4 shows the block portion 174 having the threaded opening 142 that may receive the threaded rod 138, which may be utilized to drive axial movement of the first parallel plate 114 and the second parallel plate 128 along the horizontal axis 134. Therefore, while the first parallel plate 114 and the second parallel plate 128 move along the horizontal axis 134, the swiveling base 140 (e.g., the swiveling rod 160, the annular bearing 166, the flanges 170, the top flange 172, and/or the block portion 174) may remain substantially stationary with respect to the base 66. Adjusting a position of the first parallel plate 114 and the second parallel plate 128 using the threaded rod 138 and the threaded opening 142 is discussed in more detail below with reference to FIGS. 7 and 8.

Figure 6:
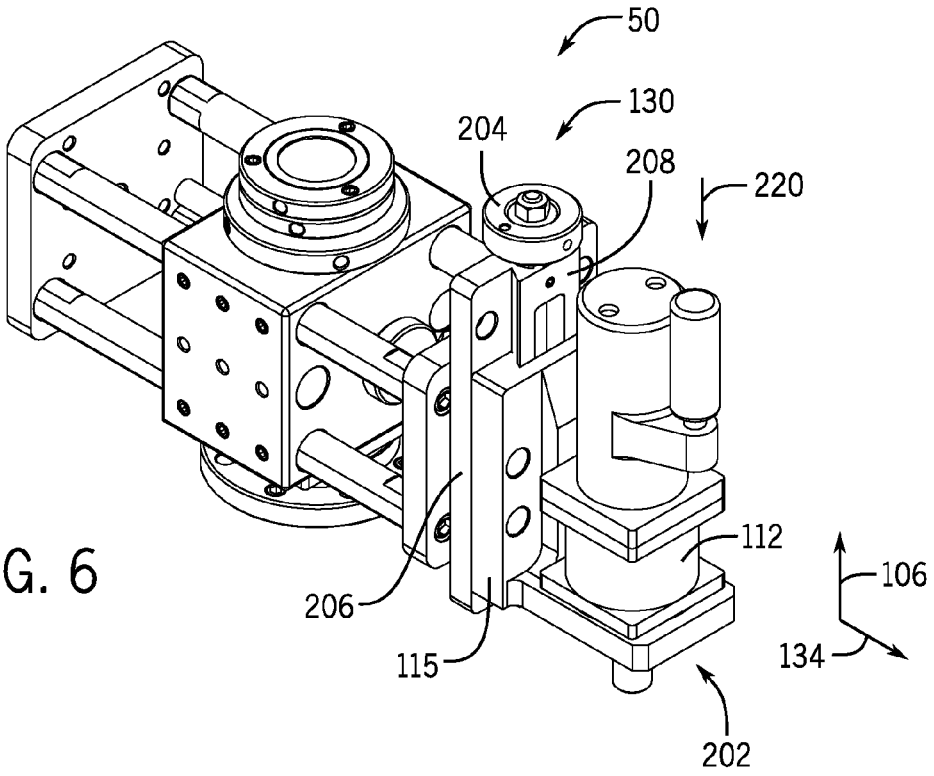
FIG. 6 is a perspective view of the multi-function tool of FIGS. 2-4 in a second vertical position, in accordance with certain embodiments of the present disclosure.

As discussed above, it may be desirable to adjust a position of the multi-function tool 50 in order to accurately and efficiently cut the auxiliary lines 60. For example, FIG. 5 is a perspective view of the multi-function tool 50 where the blade 108 (see FIG. 3), the motor 112, and the mounting plate 115 are in a first vertical position 200 and FIG. 6 is a perspective view of the multi-function tool 50 where the blade 108 (see FIG. 3), the motor 112, and the mounting plate 115 have been moved along the vertical axis 106 to a second vertical position 202.

As shown in the illustrated embodiment of FIG. 5, the blade 108 (see FIG. 3), the motor 112, and the mounting plate 115 are in the first vertical position 200 along the vertical axis 106. In certain embodiments, the vertical adjustment feature 130 may be utilized (e.g., spun in the direction 120 about the axis 109) to move the blade 108, the motor 112, and/or the mounting plate 115 to the first vertical position 200. The vertical adjustment feature 130 may include a knob 204 and a stationary plate 206 (e.g., stationary with respect to the vertical axis 106, 109). In certain embodiments, the mounting plate 115 is coupled to, and configured to move along, the stationary plate 206 via an axial joint or translational guide 205 (e.g., dovetail joint), which includes an axial protrusion 207 disposed along and interlocked with an axial groove 208. For example, the protrusion 207 may be disposed on the plate 206, while the axial groove 208 may be disposed in the mounting plate 115. The guide 205 (e.g., axial protrusion 207 and axial groove 208) enables axial movement between the plates 115, 206 in response to activation by the knob 204. Accordingly, when the knob 204 is turned in a direction 210 (e.g., by an operator), the mounting plate 115, and thus the blade 108 and the motor 112, may move along the vertical axis 106, 109. The stationary plate 206 may be mounted to the first parallel plate 114 by fasteners 212 (e.g., bolts, screws, rivets). Accordingly, the stationary plate 206 (and the vertical adjustment feature), the mounting plate 115, the blade 108, and the motor 112 may be configured to move along the horizontal axis 134 as the first plate 114 moves along the horizontal axis 134 via the guide 181. As discussed above, the knob 204 may be coupled to a threaded rod (not shown) that may be disposed in a threaded opening of the mounting plate 115, for example. Accordingly, as the knob 204 is turned in the direction 210, the threaded rod may drive the mounting plate 115 along the axis 106, 109.

As discussed above, it may be desirable to move the blade 108 along the vertical axis 106 such that the blade may contact the auxiliary line 60 at the distance 62 above the surface 54 of the flange 34. As such, the distance 62 that each auxiliary line 60 extends above the surface 54 may be approximately equal. As shown in the illustrated embodiment of FIG. 6, the mounting plate 115, the motor 112, and the blade 108 (see FIG. 3) have been moved along the vertical axis 106, 109 to the second vertical position 202. Accordingly, the knob 204 of the vertical adjustment feature 130 has been adjusted (e.g., rotated in the direction 120 or 210) such that the mounting plate 115 has moved in a direction 220 via the guide 205 (e.g., protrusion 207 and groove 208) between the plates 115, 206. The blade 108 may now be positioned at the distance 62 above the surface 54 of the flange 34 such that the multi-function tool 50 is prepared to cut the auxiliary line 60.

Additionally, it may be desirable to adjust a position of the multi-function tool 50 along the horizontal axis 134 in order to accurately and efficiently cut the auxiliary lines 60. For example, FIG. 7 is a perspective view of the multi-function tool 50 where the blade 108 (see FIG. 3), the motor 112, and the mounting plate 115 are in a first horizontal position 230 and FIG. 8 is a perspective view of the multi-function tool 50 where the blade 108 (see FIG. 3), the motor 112, and the mounting plate 115 have been moved along the horizontal axis 134 to a second horizontal position 232.

Figure 7:
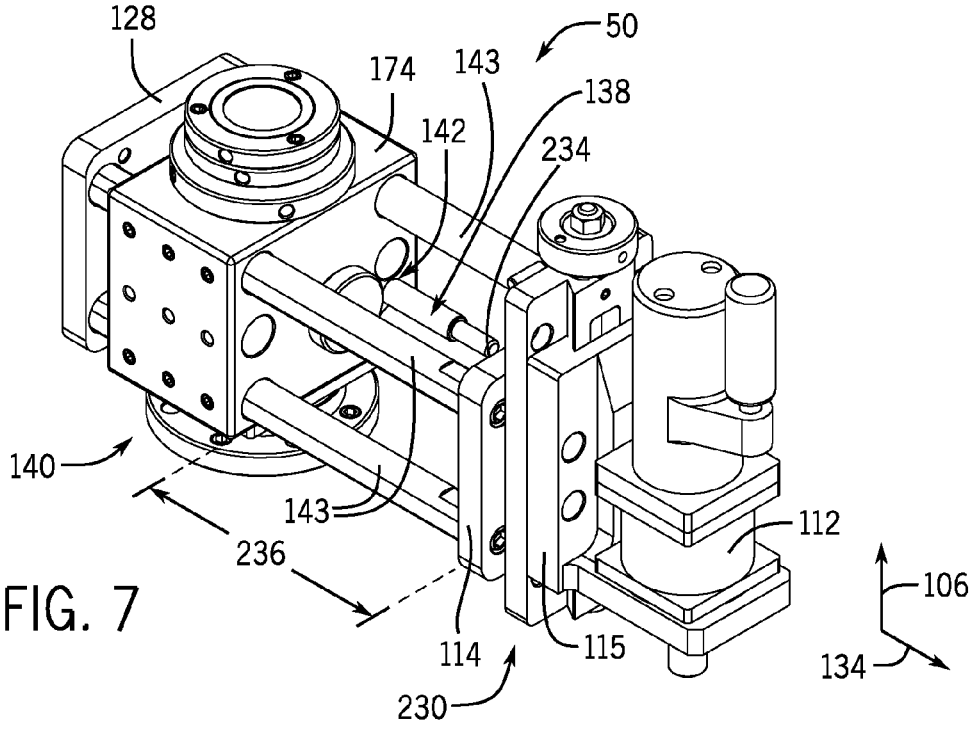
FIG. 7 is a perspective view of the multi-function tool of FIGS. 2-4 in a first horizontal position, in accordance with certain embodiments of the present disclosure.

As shown in the illustrated embodiment of FIG. 7, an end 234 of the threaded rod 138 passes completely through the block portion 174 of the swiveling base 140 (e.g., the end 234 extends past both ends of the threaded opening 142). Accordingly, the second parallel plate 128 is positioned proximate to the block portion 174 of the swiveling base 140 along the horizontal axis 134. Additionally, the first parallel plate 114 is positioned a distance 236 from the block portion 174 of the swiveling base 140. As discussed above, it may be desirable to adjust the multi-function tool 50 along the horizontal axis 134 to ensure that the blade 108 may cut through the entire perimeter 136 of the auxiliary line 60. Accordingly, an operator may adjust the horizontal adjustment feature 132 (see FIGS. 3 and 4), which may be coupled to the threaded rod 138. Accordingly, as the horizontal feature 132 (e.g., a knob) is adjusted, a position of threaded rod 138 may change within the threaded opening 142 of the swiveling base 140. Because the threaded rod 138 may be fixedly coupled to the second parallel plate 128, when the horizontal adjustment feature 132 is adjusted, the threaded rod 138 may apply a force to the second parallel plate 128 to move the first parallel plate 114 and the second parallel plate 128 along the horizontal axis 134 (e.g., because the first parallel plate 114 and the second parallel plate 128 are coupled via the rods 143).

Figure 8:
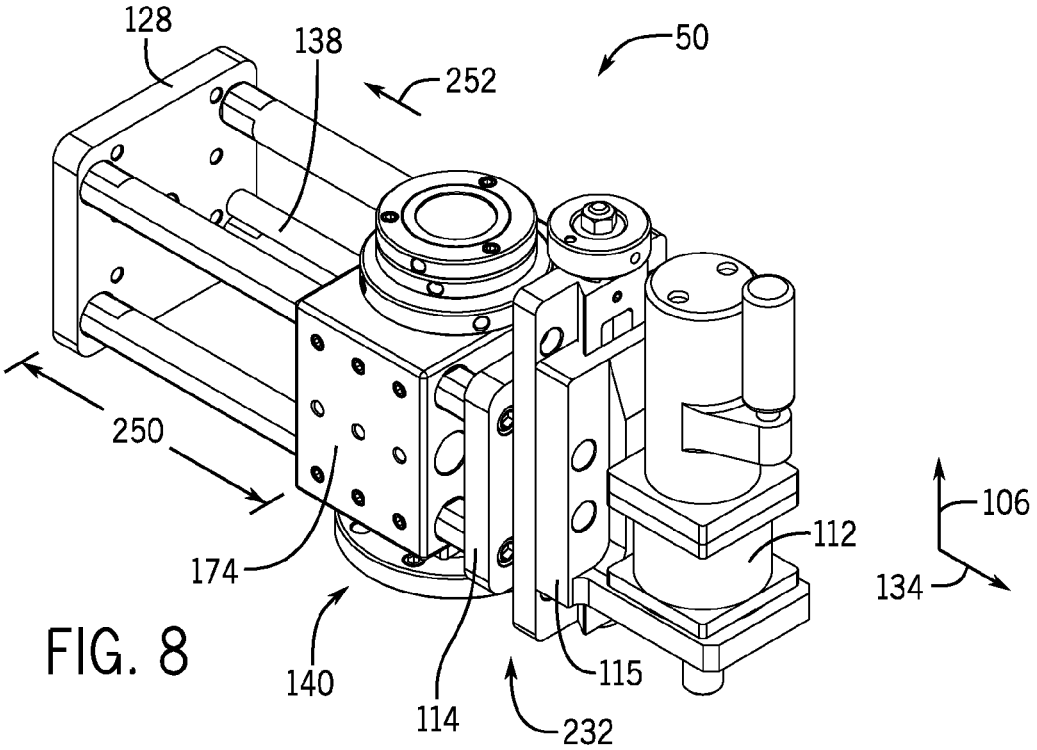
FIG. 8 is a perspective view of the multi-function tool of FIGS. 2-4 in a second horizontal position, in accordance with certain embodiments of the present disclosure.

Additionally, FIG. 8 shows the multi-function tool 50 in the second horizontal position 232 where the first parallel plate 114 is positioned proximate to the block portion 174 of the swiveling base 140 along the horizontal axis 134. Additionally, the second parallel plate 128 is positioned a distance 250 from the block portion 174 of the swiveling base 140. The threaded rod 138 may no longer completely pass through the block portion 174 of the swiveling base 140 (e.g., the threaded rod 138 may pass through a first end of the threaded opening 142 facing the first parallel plate 114, but not a second end facing the second parallel plate 128). In some embodiments, the threaded opening 142 may include a stop or protrusion 238 (see FIG. 4) configured to block the threaded rod 138 from losing contact with the threaded opening 142 (e.g., falling out of the threaded opening 142). In such embodiments, the first parallel plate 114 and the second parallel plate 128 may be moved in a direction 252 until the threaded rod 138 reaches the stop or protrusion 238 (see FIG. 4) within the threaded opening 142. As the first parallel plate 114 and the second parallel plate 128 move along the horizontal axis 134, the mounting plate 115, the motor 112, and the blade 108 (see FIG. 3) also move along the horizontal axis 134. In some cases, however, the motor 112 and/or the blade 108 may be removed from multi-function tool 50 when a function other than cutting the auxiliary lines (e.g., measurement and/or indicating) is desired.

Figure 9:
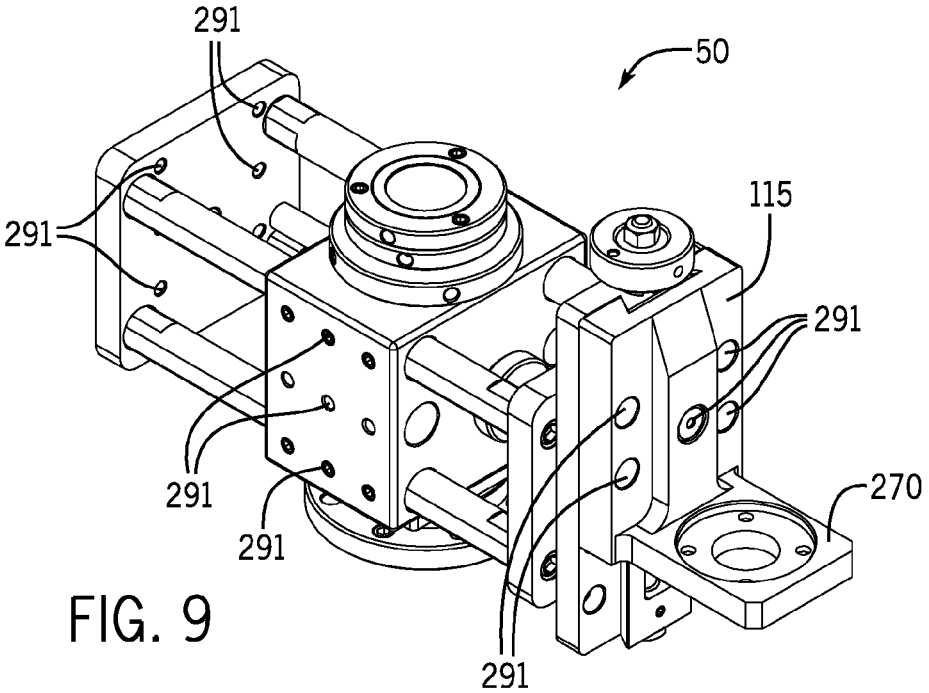
FIG. 9 is a perspective of the multi-function tool of FIGS. 2-4 showing a mounting plate with a motor and a blade removed from the mounting plate, in accordance with certain embodiments of the present disclosure.

For example, FIG. 9 is a perspective of the multi-function tool 50 when the motor 112 and/or the blade 108 have been removed from the mounting plate 115. In some embodiments, the mounting plate 115 may include a platform 270 (e.g., recess, receptacle, cup, or mounting portion) that holds and/or couples to the motor 112 and/or another device of the multi-function tool 50 (e.g., a measuring device of the multi-function tool 50). As discussed above, it may be desirable for the multi-function tool 50 to include a measurement function that may determine whether one or more surfaces of the flange 34 are within predetermined tolerance specifications. For example, a dial indicator 290 may be coupled to the platform 270 or other structures of the multi-function tool 50 at one or more indicator mounts 291 in order to measure one or more surfaces of the flange 34, as shown in FIG. 10.

Figure 10:
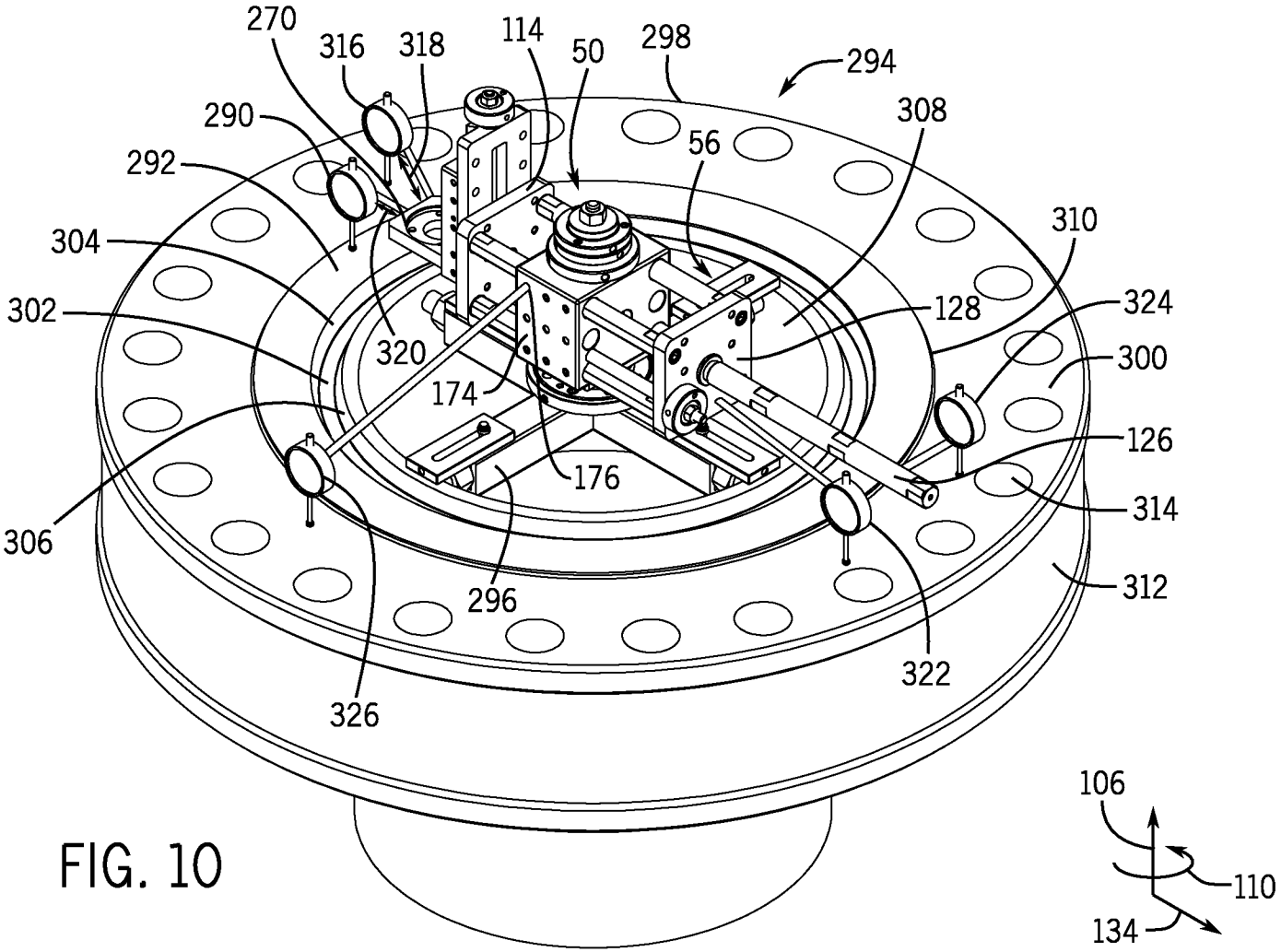
FIG. 10 is a perspective view of the multi-function tool of FIGS. 2-4 center-mounted on a riser segment flange and having a dial indicator to measure one or more surfaces of the flange, in accordance with certain embodiments of the present disclosure.

As shown in the illustrated embodiment of FIG. 10, the multi-function tool 50 may include the dial indicator 290 to measure a first surface 292 of a raised-face flange 294. FIG. 10 shows the multi-function tool 50 center-mounted to the raised-face flange 294 via a cross mount 296 as opposed to the base 66 of FIGS. 2 and 3. While the multi-function tool 50 having the measurement function (e.g., the dial indicator 290) is shown center-mounted to the raised-face flange 294, it should be noted that the multi-function tool 50 may be mounted to and used to measure a variety of riser flanges (e.g., blind flanges, flat flanges, flanges that include multiple surfaces). Additionally, it should be noted that while the multi-function tool 50 shown in the illustrated embodiment of FIG. 10 is center-mounted using the cross mount 296, other suitable mounting techniques may be utilized to mount the multi-function tool 50 to the raised-face flange 294 (or another riser flange).

In certain embodiments, the cross mount 296 may enable the multi-function tool 50 to be disposed over the main line 56 of the riser. As such, the multi-function tool 50 may rotate about the circumferential axis 110 such that the dial indicator 290 may measure the first surface 292 about an entire circumference 298 of the flange 294. As shown in the illustrated embodiment, the dial indicator 290 may be configured to measure the first surface 292 such that an operator utilizing the multi-function tool 50 may determine whether parameters (e.g., flatness, uniformity, evenness, inner diameter, outer diameter, circumference, angle, curvature, and/or thickness, among other parameters) of the first surface 292 are within predetermined tolerance values for the first surface 292. The dial indicator 290 may be configured to measure a variety of surfaces such as a flat surface (e.g., the first surface 292, a second surface 300, a third surface 302), an angled surface (e.g., a fourth surface 304, a fifth surface 306), a round surface, an inner diameter of a pipe or conduit (e.g., a sixth surface 308), an outer diameter of a pipe or conduit (e.g., a seventh surface 310, an eight surface 312), a spherical surface, a tapered surface, and/or a portion of a surface (e.g., one or more indentations 314), among others.

In some embodiments, the dial indicator 290 may be re-positioned on the platform 270 so that it may measure (e.g., indicate) any of the surfaces 292, 300, 302, 304, 306, 308, 310, 312, or 314 of the raised-face flange 294. Additionally, the multi-function tool 50 may include multiple indicators coupled to virtually any part of the multi-function tool 50 (e.g., at the one or more indicator mounts 291). For example, the dial indicator 290 may be coupled to the platform 270. Additionally, a second indicator 316 may also be coupled to the platform 270. As shown in the illustrated embodiment of FIG. 10, the second indicator 316 may include a length 318 longer than a length 320 of dial indicator 290. In other embodiments, more than two indicators may be coupled to the platform 270 (e.g., 3, 4, 5, 6, 7, 8, 9, 10, or more indicators). In still further embodiments, the platform 270 may be removed from the multi-function tool 50 such that the dial indicator 290 and the second indicator 316 are coupled to the multi-function tool 50 at the first parallel plate 114. It should be noted that the indicators 290, 316 may be mounted to the multi-function tool 50 at various vertical heights (e.g., distances from the flange 34 along the vertical axis 106, 109), various radii relative to a central axis (e.g., a center of the main line 56), various horizontal positions (e.g., distances from the multi-function tool 50), various angles, or any combination thereof.

For example, in certain embodiments, a third indicator 322 may be coupled to the second parallel plate 128 of the multi-function tool 50. Additionally, a fourth indicator 324 may be coupled to the second handle 126 of the second parallel plate 128. Further still, a fifth indicator 326 may be coupled to an opening 176 of the block portion 174 of the swiveling base 140. It should be noted that each of the openings 176 may include a separate indicator that each may be configured to measure (e.g., indicate) a separate surface. Accordingly, the multi-function tool 50 may include any suitable number of indicators to measure one or more of the surfaces 292, 300, 302, 304, 306, 308, 310, 312, or 314 of the raised-face flange 294. In some embodiments, the measurements may be taken simultaneously such that determination of whether each surface 292, 300, 302, 304, 306, 308, 310, 312, or 314 of the raised-face flange 294 meets predetermined tolerances may be performed with an enhanced efficiency.

In some cases, the one or more indicators 290, 316, 322, 324, and/or 326 may be utilized to accurately center the cross mount 296 over the main line 56. Centering the cross mount 296 may increase an accuracy of the measurements of the surfaces 292, 300, 302, 304, 306, 308, 310, 312, or 314 of the raised-face flange 294.

Figure 11:
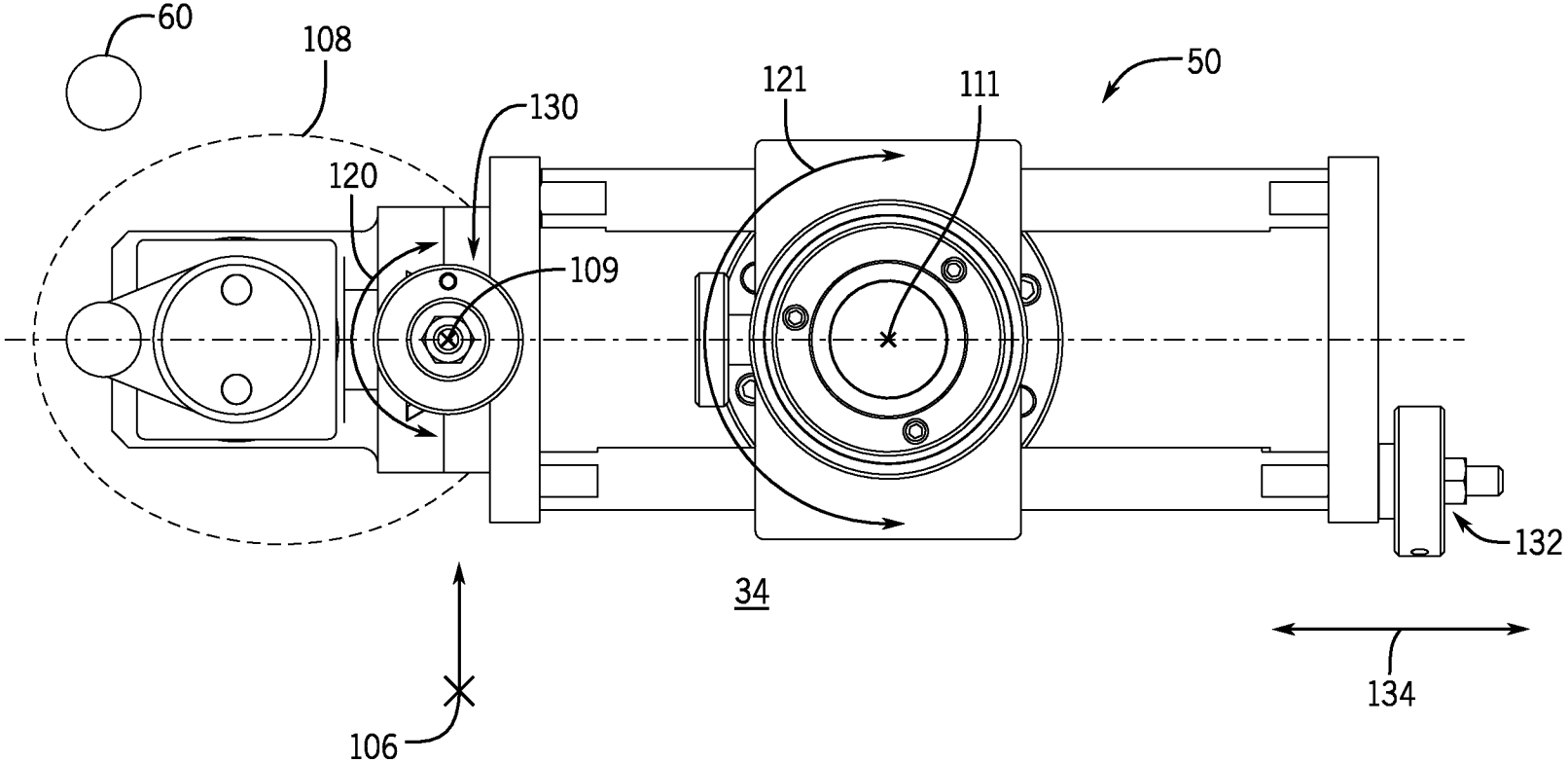
FIG. 11 is an overhead view of the multi-function tool illustrating the multiple degrees of freedom of the multi-function tool, in accordance with certain embodiments of the present disclosure.

As discussed above, the multi-function tool 50 may include three or four degrees of freedom that may enable the multi-function tool 50 to be manipulated and adjusted to cut auxiliary lines 60 a desired height as well as to make the measurements using the indicators 290, 316, 322, 324, and/or 326. For example, FIG. 11 is an overhead view of the multi-function tool 50 illustrating the various degrees of freedom of the multi-function tool 50. It should be noted that while the degrees of freedom of the multi-function tool 50 are discussed with respect to the cutting function of the multi-function tool 50 in FIG. 11, the same degrees of freedom are present when utilizing the multi-function tool 50 to measure the various surfaces of the flange 34.

As shown in the illustrated embodiment, the multi-function tool 50 may be mounted on the flange 34. Once the multi-function tool 50 has been mounted to the flange 34, the multi-function tool 50 may be adjusted along the horizontal axis 134 via the horizontal adjustment feature 132 such that the blade 108 may be configured to cut through the entire perimeter 136 of the auxiliary line 60. In some embodiments, the multi-function tool 50 may be adjusted about the axis 111 and along the horizontal axis 134 simultaneously. Additionally set screws (e.g., threaded fasteners, screws, bolts, etc.) may be utilized to fix the multi-function tool 50 in a position along the horizontal axis 134 such that the multi-function tool is substantially fixed with respect to axis 134.

As discussed above, it may be desirable to cut the auxiliary line 60 such that it extends the distance 62 above the flange 34 that is substantially aligned with the remaining auxiliary lines 60. Accordingly, the multi-function tool 50 may be adjusted about the vertical axis 106, 109 (e.g., via the vertical adjustment feature 130) such that the blade 108 is positioned at the distance 62. Again, a set screw (e.g., a threaded fastener, a screw, a bolt, etc.) may be utilized to substantially fix the multi-function tool 50 with respect to the vertical axis 106, 109 such that the blade 108 is at the distance 62.

Once the multi-function tool 50 is substantially fixed with respect to the axes 106, 109, and/or 134, the blade 108 may be rotated in the direction 121 about the axis 111 such that the blade 108 may cut through the entire auxiliary line 60, while the remaining components of the multi-function tool 50 remain substantially stationary. Accordingly, the auxiliary line 60 may be cut efficiently, accurately, and evenly by blocking at least some movement of the multi-function tool 50 (e.g., via the set screws) when the blade 108 cuts the auxiliary line 60.

While the present disclosure may be susceptible to various modifications and alternative forms, specific embodiments have been shown by way of example in the drawings and have been described in detail herein. However, it should be understood that the present disclosure is not intended to be limited to the particular forms disclosed. Rather, the present disclosure is to cover all modifications, equivalents, and alternatives falling within the spirit and scope of the invention as defined by the following appended claims.

The invention claimed is:

1. A multi-function tool, comprising:

a positioning assembly configured to move with a first degree of freedom of rotation, a second degree of freedom of axial movement in a first direction, and a third degree of freedom of axial movement in a second direction crosswise to the first direction;

a cutting tool configured to selectively couple to the positioning assembly, wherein the cutting tool comprises a drive configured to move the cutting tool with a fourth degree of freedom of rotation, and wherein the cutting tool is configured to cut through an entire perimeter of a tubing of a tubing assembly; and a measurement tool configured to selectively couple to the positioning assembly, wherein the measurement tool is configured to measure a surface of the tubing assembly to determine whether the surface meets target tolerance specifications, and wherein the measurement tool comprises a plurality of indicators coupled to the positioning assembly, wherein each indicator of the plurality of indicators is configured to measure one or more parameters via contact with the surface of the tubing assembly.

2. The multi-function tool of claim 1, comprising a mounting base configured to selectively couple the positioning assembly to an end portion of the tubing assembly.

3. The multi-function tool of claim 2, wherein the mounting base is configured to couple the multi-function tool across a central bore of a main tubing of the tubing assembly.

4. The multi-function tool of claim 2, wherein the end portion is a flange, the tubing assembly is a riser segment of a drilling riser, and the tubing assembly comprises a main tubing and the tubing.

5. The multi-function tool of claim 4, wherein the mounting base is configured to couple the multi-function tool to the flange of the riser segment.

6. The multi-function tool of claim 1, wherein the drive comprises at least one of an electric motor, a hydraulic motor, or a pneumatic motor.

7. The multi-function tool of claim 1, wherein the positioning assembly comprises a tubing adapter insert selectively coupled to a mounting base, wherein the tubing adapter insert comprises a bore configured to pass the tubing.

8. The multi-function tool of claim 7, wherein the mounting base comprises first and second mounting interfaces disposed on opposite sides of the tubing adapter insert, and the positioning assembly is configured to mutually exclusively couple to one of the first or second mounting interfaces.

9. The multi-function tool of claim 1, wherein the measurement tool comprises a plurality of indicator mounts each configured to selectively mount an indicator of the plurality of indicators.

10. The multi-function tool of claim 1, wherein the measurement tool comprises at least one indicator configured to measure one or more parameters of a flat surface, an angled surface, a round surface, an inner diameter of a conduit, an outer diameter of a conduit, a spherical surface, a tapered surface, a portion of a surface, or any combination thereof.

11. The multi-function tool of claim 1, wherein the positioning assembly comprises a swivel joint configured to move with the first degree of freedom of rotation, a first axial translational joint configured to move with the second degree of freedom of axial movement in the first direction, and a second axial translational joint configured to move with the third degree of freedom of axial movement in the second direction crosswise to the first direction.

12. The multi-function tool of claim 11, wherein the swivel joint is coupled to a mounting base, the first axial translational joint is coupled to the swivel joint, the second axial translational joint is coupled to the first axial translational joint, and a mounting portion is coupled to the first axial translational joint, wherein the cutting tool and the measurement tool are configured to selectively couple to the mounting portion.

13. The multi-function tool of claim 11, wherein the first axial translational joint comprises a plurality of rods extending between opposite first and second plates, and the plurality of rods extend through openings in a rotating portion of the swivel joint.

14. The multi-function tool of claim 11, wherein the second axial translational joint comprises an axial protrusion interlocked with an axial groove or a dovetail joint.

15. The multi-function tool of claim 1, wherein an indicator of the plurality of indicators comprises a dial indicator.

16. The multi-function tool of claim 1, wherein the cutting tool comprises a blade comprising a diamond-based material.

17. A tool, comprising:

a positioning assembly configured to move with a first degree of freedom of rotation, a second degree of freedom of axial movement in a first direction, and a third degree of freedom of axial movement in a second direction crosswise to the first direction;

a cutting tool configured to selectively couple to the positioning assembly, wherein the cutting tool comprises a drive configured to move the cutting tool with a fourth degree of freedom of rotation; and a mounting base configured to selectively couple the positioning assembly to an end portion of a tubing assembly, wherein the cutting tool is configured to cut through an entire perimeter of at least one tubing of the tubing assembly.

18. The tool of claim 17, comprising a plurality of tubing adapter inserts configured to mutually exclusively couple to the mounting base, wherein each insert of the plurality of tubing adapter inserts is sized differently to accommodate a different tubing of the tubing assembly.

19. A tool, comprising:

a positioning assembly configured to move with a first degree of freedom of rotation, a second degree of freedom of axial movement in a first direction, and a third degree of freedom of axial movement in a second direction crosswise to the first direction; and a measurement tool configured to selectively couple to the positioning assembly, wherein the measurement tool is configured to measure a surface of a tubing assembly to determine whether the surface meets target tolerance specifications, wherein the measurement tool comprises a plurality of indicators coupled to the positioning assembly, wherein each indicator of the plurality of indicators is configured to measure one or more parameters via contact with the surface of the tubing assembly, wherein the positioning assembly comprises a plurality of indicator mounts each configured to selectively mount an indicator of the plurality of indicators, wherein a first indicator mount of the plurality of indicator mounts is disposed on the positioning assembly at a first height relative to a mounting base of the positioning assembly, wherein a second indicator mount of the plurality of indicator mounts is disposed on the positioning assembly at a second height relative to the mounting base, and wherein the second height is different from the first height.

20. The tool of claim 19, wherein the mounting base is configured to selectively couple the positioning assembly to an end portion of the tubing assembly, wherein the measurement tool is configured to measure at least one portion of the tubing assembly.

21. The tool of claim 19, wherein an indicator of the plurality of indicators comprises a dial indicator.

22. The tool of claim 19, wherein the positioning assembly comprises a handle configured to facilitate movement of the tool with respect to the first degree of freedom of rotation, and wherein an indicator of the plurality of indicators is mounted to an indicator mount of the plurality of indicator mounts on the handle.

* * * * *